US006021870A

United States Patent [19]

Kim

[11] Patent Number: 6,021,870

[45] Date of Patent: Feb. 8, 2000

[54] CAR INFORMATION INDICATING APPARATUS

[75] Inventor: Cheol Wan Kim, Inchun-Si, Rep. of Korea

[73] Assignee: LG Industrial Systems Co., Ltd., Seoul, Rep. of Korea

[21] Appl. No.: 09/064,877

[22] Filed: Apr. 23, 1998

[30] Foreign Application Priority Data

Apr. 24, 1997 [KR] Rep. of Korea ..... 97-15310

[51] Int. Cl.[7] ..... B66B 1/28

[52] U.S. Cl. ..... 187/247; 127/391; 127/397

[58] Field of Search ..... 187/247, 240, 187/391, 397, 398, 380, 399

[56] References Cited

U.S. PATENT DOCUMENTS 4,497,391 2/1985 Mendelsohn ..... 187/380
4,709,788 12/1987 Harada ..... 187/382
4,778,035 10/1988 Tanino ..... 187/395
4,860,207 8/1989 Kubo ..... 364/424.01
4,872,532 10/1989 Tobita et al. ..... 187/380
5,398,783 3/1995 Jacoby ..... 187/395
5,848,669 12/1998 Park ..... 187/247

*Primary Examiner*—Jonathan Salata
*Attorney, Agent, or Firm*—Birch, Stewart, Kolasch & Birch, LLP

[57] ABSTRACT

A car information indicating apparatus for elevator cars displays elevator movement information by using signal relaying devices that do not include separate CPUs. Each signal relaying device is capable of receiving/processing data representative of car information from the car controller and of transmitting to a plurality of car position indicators on each floor landing, resulting in an elevator system that has a more simple construction and reduces cost.

5 Claims, 6 Drawing Sheets

CAR INFORMATION INDICATING APPARATUS

BACKGROUND OF THE INVENTION

1. Field of the Invention

The present invention relates to a car information indicating apparatus for a plurality of elevator cars at each floor landing in a multi-storey building where more than two elevator cars are providing service to passengers in parallel. More particularly, the present invention relates to an apparatus for operating a plurality of hall indicators, by which a plurality of running information are displayed at the various indicators with the use of only signal relaying means including dual direction communication devices instead of a central processing unit (Hereinafter, referred as CPU). This apparatus results in a more simple configuration of the apparatus.

2. Description of the Prior Art

The communication network for operating a plurality of indicators in an elevator system of the present invention includes a serial communication network which may be considered to be much more advantageous compared to a parallel communication network in that it cuts an operating cost of, and is easy to install and to maintain an elevator system.

Such a serial communication network is normally provided with the plurality of signal relaying means including a CPU for each of floors in a building. When such relaying means including a CPU are used in the system, a plurality of memory devices such as a random access memory (Hereinafter, referred to as RAM) as well as read-only memory (Hereinafter, referred to as ROM) are also needed essentially for each CPU resulting in the elevator system with increased manufacturing costs.

The serial communication network in the elevator system of the present invention is therefore developed not to use many CPUs so as to reduce the manufacturing costs associated with the memory devices described above. In the serial communication network which does not need many CPUs, car controllers should be linked via a plurality of communication lines to a plurality of car position indicators and a car traveling direction indicators installed at each floor landing so as to transmit/receive the respective information representative of a current elevator car position and a traveling direction of a selected elevator car. Such a system needs a plurality of communication lines between them.

For an example, more than 8 communication lines are needed in a building where a single elevator car is running to provide passengers with a service, and more than 16 communication lines are needed accordingly where a two elevator car group is running. Such a large number of communication lines required in the communication network enlarges the size of the signal relaying means and increases manufacturing costs.

The communication network for controlling two elevator cars to operate in parallel fashion will now be described as an example.

FIG. 1 is a schematic block diagram of conventional car information indicating apparatus for a couple of elevator cars. The car information indicating apparatus 10,20 are respectively represented for two elevator cars which are traveling in parallel sharing a single hall call board (in the FIG. 1, every hall call board 16, 17 and 18 is connected to a first elevator car controller 11).

Referring further to the FIG. 1, a conventional car information indicating apparatus 10 for the first elevator car includes a car position detecting means 11D, a car traveling direction detecting means 11E, a car controller 11, a floor controller 12, a plurality of car position indicators 13~15 installed at each floor landings, and a plurality of hall call boards 16~18. The car position detecting means 11D enables the master processing unit 11A of the car controller 11 to arithmetically calculate the number of total output pulses transmitted from a revolution counter normally installed at a drive shaft of a motor so as to get an arbitrary number representative of the current floor landing at which the elevator car is positioned. The car traveling direction detecting means 11E are normally utilizing either of a clockwise revolution counter for counting the number of clockwise revolutions transmitted from the motor revolution counter or as a counter-clockwise revolution counter for counting the number of counter-clockwise revolution transmitted from the motor revolution counter.

The car controller 11 includes a master processing unit 11A for controlling the first elevator car movement, receiving a plurality of hall call signals, communicating via communication line TL1 with the respective floor controller 12 so as to eventually display the service floor, and communicating via communication line TL4 with a car controller 21 so as to exchange inter-elevator messages. The floor controller 12 incorporates dual port RAM 12A for being capable both of transmitting and of receiving the data, a slave processing unit 12B for exchanging the data with the car controller 11 via the dual port RAM 12A, and two of one-way communication devices 12C, 12D for outputting the data representative of the current car position, movement direction of the respective elevator car and for receiving the hall call signals. The car position indicators 13~15 are disposed at each floor, each including a single one-way communication device 13A~15A respectively for receiving the data representative of a car position from the floor controller 12 and then transmitting the same data to a digital display matrix 13B~15B arranged as a seven-segment display for receiving the data from the one-way communication device 13A~15A and then illuminating itself accordingly to display the floor number representative of the current position of the assigned elevator car. The hall call board 16~18 is also respectively disposed at each floor landing, each including a one-way communication device 16A~18A, a hall call button 16B~18B for generating/transmitting the hall call signal to the only communication-purpose repeater 12 via a communication line TL3 and for displaying the elevator movement data received from the floor controller 12, and a car traveling direction indicator 16C–18C in a light emitting diode (not shown) for indicating a traveling direction as either upward direction or downward direction.

Here, the car position detecting means 11D can also be realized as the motor revolution counter or the position detector disclosed in the Japanese Patent No. 86-49671 filed by Ikkegima Satomi, et al, and assigned to Mitsubishi Denki Kabushiki Kaisha or the U.S. Pat. No. 4,094,385 respectively. The car position detecting means 11D first of all accumulatively counts the number of output pulses generated at the motor revolution counter installed normally at the motor shaft from the start point until the current time so as to provide to the car controller 11 and the car controller 11 converts incoming count number to a data value representative of how long distance the respective elevator car should move, which is proportional to the count number, compares the distance-related data with a data representative of a distance between neighboring floor landings stored in a memory device, and eventually determines the current position of the elevator car.

The information data representative of the position of the elevator car determined as above can be certified by both a cut-off plate located some distance away from the bottom surface of a floor at which the respective elevator car is stopped to provide passengers with the service, and a position detector installed on the top edge of the elevator car. The position detector installed on the top edge of the elevator car is realized of either a combination of both a light emitting section and a light receiving section or a magnetic flux generating section. The car controller 11 can determine whether or not the elevator car is traveled over distance corresponding to one between neighboring floor landings, as a light signal or magnetic flux is cut off when the elevator car is reached at the respective floor landing resulting in that the cut-off plate becomes to stand between a light emitting section and a light receiving section or the magnetic flux generating means.

The car traveling direction detecting means 11E, as a motor revolution counter outputting pulse signals upon the receipt of either the clockwise motor revolution or the counter-clockwise motor revolution, can be realized with the use both the clockwise revolution counter and the counter-clockwise revolution counter. The car traveling direction detecting means 11E determines as the respective elevator car is traveling upward when there is an incoming clockwise count data, and determines as the respective car is traveling downward when there is an incoming counter-clockwise count data.

As can be seen in FIG. 1, the car information indicating apparatus 20 for second elevator car is constructed as the same as the car information indicating apparatus 10 except the fact that the apparatus 20 does not include hall call boards. The unexplained reference symbols, TL5 and TL6 are communication lines.

The car controller 11 is connected to the floor controller 12 via the communication line TL1, and the floor controller 12 is connected to both of the car position indicators 13~15 and to the hall call boards 16~18 via the communication lines TL2 and TL3 respectively. Similar to the car information indicating apparatus 10 for the first elevator car, the car information indicating apparatus 20 for the second elevator car is constructed such that its car controller 21 is connected to its floor controller 22 via a communication line TL5, and the repeater 22 is connected to its car position indicators 23, 24 and 25 via a communication line TL6 accordingly.

The car controller 11 for the first elevator car is connected to the car controller 21 for via the communication line TL4 so as to exchange the inter-elevator message, and as a result the first elevator car and the second elevator car may share common hall call board 16~18 together at each floor landing. An one-way communication device 22D therefrom is remained not to be connected to anything at all.

FIG. 2 is a block diagram of the car position indicators 13~15, 23~25 shown in the FIG. 1. Referring now to FIG. 2, each of the car position indicator(13, in the FIG. 2) includes a pulse transformer 13C for receiving bipolar coded car position data via communication line TL2 and amplifying the same data signal to a certain level, an input interface unit 13D for converting the incoming bipolar coded data signal transmitted from the pulse transformer 13C to the binary coded data, a one-way communication device 13A for outputting the same data signal in parallel after recognizing and reading the data, a buffer 13E for temporarily storing the same data received from the one-way communication device, and a digital display matrix 13B arranged as a seven-segment display (used in the embodiment) for decoding the data received from the buffer, and illuminating respective segments being indicative of the arbitrary number of the current car position.

Referring now to the FIG. 3, the operation routine of the car information indicating apparatus 10, 20 will be described assuming that the car information indicating apparatus 10 is a master, and the car information indicating apparatus 20 is a slave accordingly. The car controller 11, 21 independently controls the hall indicating functions of the first and the second elevator car with the use of each slave processing unit 12B, 22B respectively.

Returning to the FIG. 3, if the power is supplied to the system, the system is accordingly activated by in S201. S202 is executed, in which each master processing unit 11A, 21A disposed in car controllers 11, 21 respectively writes the reset data in the dual port RAM 12A, 22A disposed in the floor controller 12, 22 via the communication line TL1,TL5 respectively. Each of slave processing units 12B, 22B thereafter resets the dual port RAMs 12A, 22A by reading the stored data at the dual port RAMs 12A, 22A. After that, each of the master processing units 11A, 21A in the car controllers 11, 21 communicates S203 the inter-elevator messages representative of running information indicating data signal from each other through the communication line TL4 for assigning an optimum elevator car and determines the current position and the traveling direction of the elevator car with the use of the car position detecting means 11D and the car traveling direction detecting means 11E, and then writes S204 the exchanged data at the dual port RAMs 12A, 22A.

After that, each of the slave processing units 12B, 22B sets S205 initial values at the registers of the one-way communication devices 12C, 12D, 22C and 22D after an access to the data stored at the dual port RAMs 12A, 22A.

Then, each of the slave processing units 128, 22B resets S206 the transmission buffer in each of one-way communication devices 12C, 12D, 22C, and 22D with the initial values before the transmission of the data representative of car position, and then checks S207 the status of each one-way communication devices 12C, 12D, 22C, and 22D, and determines S208 whether or not the status of each one-way communication devices 12C, 12D, 22C and 22D is busy.

If the result of the S208 is 'not busy', each of the slave processing units 12B, 22B writes S209 the car position data at the transmission buffer in each one-way communication devices 12C, 22C, and then makes one-way communication devices 12C, 22C transmit S210 the car position data through each of the communication line TL2, TL6 to the respective elevator car position indicators 13~15, 23~25 at the floor landing which created a hall call request. The respective car position indicators 13~15, 23~25 thereafter receive the same message through internal communication devices 13A–15A, 23A–25A and sends it to the digital display matrix 13B~15A, 23B~25B. The digital display matrix 13B~15B, 23B~25B receives the message from the respective car position indicators 13~15, 23~25 and displays S211 the arbitrary number of car position accordingly.

The passengers who are waiting for the elevator car at the floor landing can therefore realize the car position and movement direction of the assigned elevator car by looking at the digital display matrix 13B~15B, 23B~25B of the car position indicators 13–15 and the car traveling direction indicators 16C–18C of the hall call board 16–18.

On the other hand, though it is not shown in the FIG. 3, if one of the hall call buttons 16B, 17B and 18B is pressed at any one of the hall call boards 16~18, the hall lamp in the board is turned on immediately and at the same time, transmits the hall call request message out via the respective one of floor controllers 16A~18A to the communication line TL3. The slave processing unit 12B in the floor repeater 12 receives the hall call request message via the one-way communication device 12D, writes the message at the dual port RAM 12A. Then, the master processing unit 11A of the car controller 11 receives the same message, reads it, and transmits it to the master processing unit 21A of the car controller 21 for the second elevator. As a result, the two elevators share the common hall call board at each floor so that the efficiency of the elevator system is increased.

However, as explained above, the car information indicating apparatus 20 for a second elevator car is constructed to share both the hall call buttons 16B–18B and the car traveling direction indicators 16C–18C in the hall call board 16~18 for the first elevator car through using the one-way communication device 12D of the floor controller 12 so that an one-way communication device 22D of the floor controller 22 may not participate in performing the car information indicating function at all.

In the conventional running information indication apparatus as described above, the slave CPU in each of the floor controllers as well as additional separate networks of communication lines for each elevator car may be needed to perform the hall indicating function resulting in the increased manufacturing cost of the total elevator system. Besides, the monolithic integrated circuit boards used for implementing the floor controller functioning as a signal relaying means is expensive because it is already set up including expensive communication devices for communication and a CPU at the time of purchase so that it may have the limit to reduce the manufacturing cost of conventional car information indicating apparatus to a desired level.

SUMMARY OF THE INVENTION

Therefore, the object of the present invention is to provide a more simply constructed and less expensive car information indicating apparatus where at least two elevators are running in parallel in a building, in which an elevator movement information is displayed by using an hall floor communication repeater not including a CPU but a dual direction communication device rather than a floor controller including a plurality of one-way communication devices as well as CPU.

To achieve the above-mentioned objective, the present invention provides the car information indicating apparatus comprising: a hall call button installed on at least one on each floor landing for generating a corresponding hall call signal when a passenger presses the hall call button down; a plurality of car controllers whose number is corresponding to the number of the plurality of elevator cars, having signal relaying means, and for accordingly outputting an elevator car position related information signal, an elevator car traveling direction related information signals, and a car position indicator selection signal upon the receipt of a car position signal, a traveling direction signal, and a hall call signal from the position detecting means, the traveling direction detecting means, and the hall call button respectively, and for communicating with each other so as to exchange the elevator car position related information signal, the elevator car traveling direction related information signal, and the car position signal; a commonly shared serial communication line connecting the plurality of car controllers; a plurality of signal relaying means, each of which is arranged at each floor landing for each of the car controller by all being connected to each other through the commonly shared communication line, having a communication device and being connected to the hall call button thereby being capable of transmitting the hall call signal generated at the hall call button through the communication device to the corresponding car controller, also being capable of outputting signals representative of car position information as well as selection signals for selecting a respective indicator in response to a current position signal, a traveling direction signal, and a selection signal selecting one of the plurality of signal relaying means transmitted through the commonly shared communication line from the corresponding car controller; a plurality of car position indicators arranged on each of the floor landing by the same number with the elevator cars and connected to the signal relaying means so as to receive the current position signal of the respective elevator car from the signal relaying means and to thereafter indicate the received current position signal; a plurality of car traveling direction indicators each arranged on each of the floor landing commonly for two elevators and connected to the respective signal relaying means, and receiving therefrom the signal representative of current car traveling direction so as to indicate the information signal representative of current car traveling direction; and a plurality of lines for connecting the plurality of hall call buttons, the plurality of car traveling direction indicators, and the plurality of car position indicators to the plurality of signal relaying means. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Hereinafter, a preferred embodiment of the present invention will be described in detail with reference to the accompanying drawings.

Figure 4:
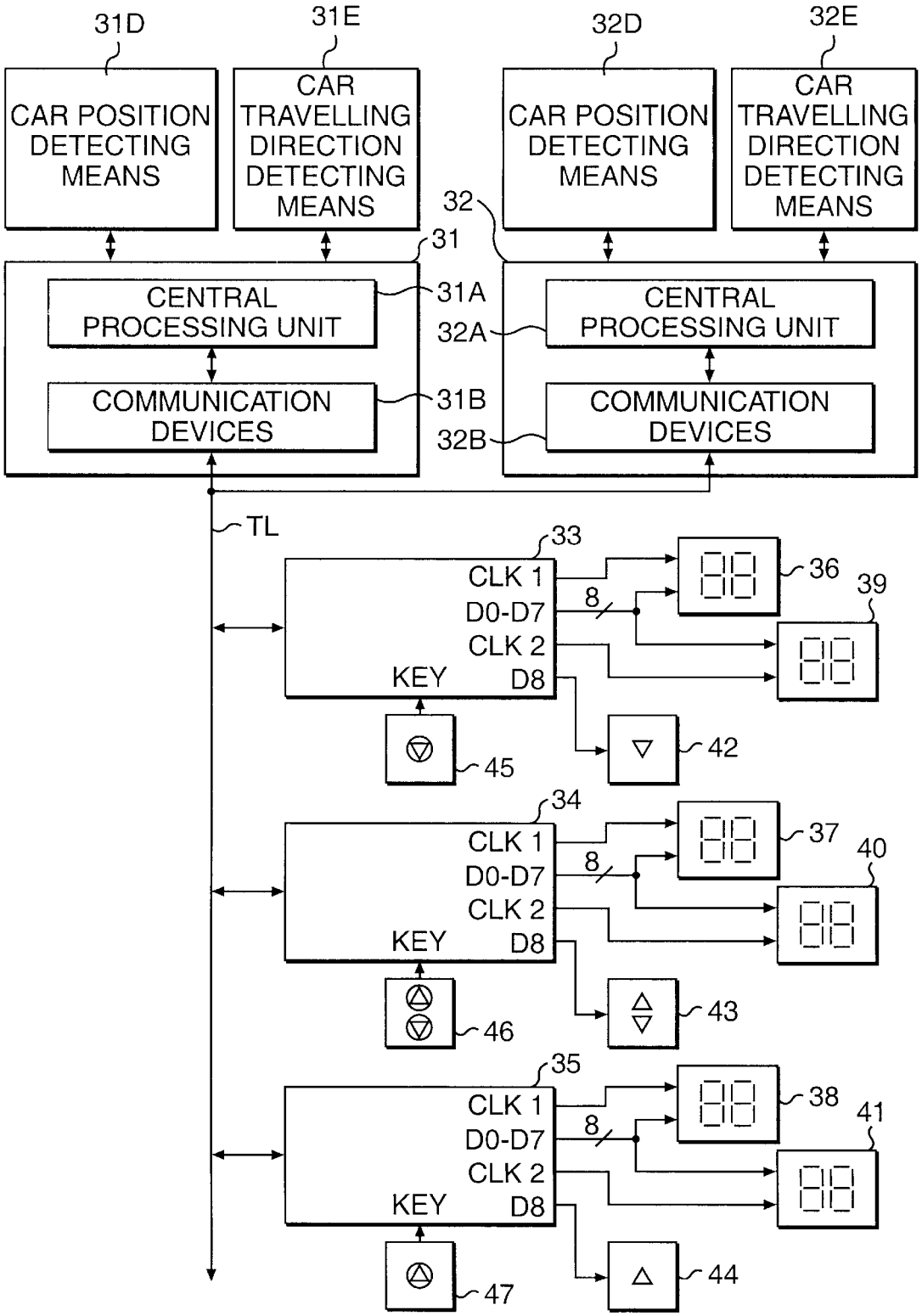
FIG. 4 is a schematic diagram showing one exemplary embodiment of the apparatus for indicating car position information according to the present invention.

FIG. 4 is a schematic diagram of car information indicating apparatus of the present invention for a two-elevator car group in which two elevator cars are running to provide passengers with service using a serial communication network. Referring to FIG. 4, in an elevator system in a multi-storey building where a plurality of elevator cars are running together, having a position detecting means 31D 32D, and a traveling direction detecting means 31E 32E, both of whose number are corresponding to the number of the elevator cars respectively for detecting a current car position of one of the plurality of elevator cars and for detecting a traveling direction of the one of the plurality of elevator cars. The car information indicating apparatus of the present invention includes: a plurality of hall call buttons 45–47 installed at least one on each floor landing for generating a corresponding hall call signal when passenger (s) presses the hall call button down; a plurality of car controllers 31, 32 whose number is corresponding to the number of the plurality of elevator cars, each car controller 31, 32 having a central processing unit 31A 32A and a dual direction communication devices 31B 32B for respectively encoding the information signals received from the central processing unit and transmitting the processed codes for determining the corresponding car position indicator. The dual direction communication devices 31B, 32B are of transmitting the determined running information of a corresponding elevator car such as the current position information and the car traveling direction information as well as the selection signal selecting the corresponding car position indicator to the firstly selected car position indicator. The selection signal is generated response to the plurality of incoming detected signals from the car position detecting means 31D 32D, the car traveling direction detecting means 31E 32E as well as hall call button 45–47. The car information indicating apparatus further includes: a commonly shared serial communication line TL connecting the plurality of car controllers; a plurality of signal relaying means 33–35 each of which is arranged at every floor landing corresponding to each of the car controller by all being connected to each other through the commonly shared communication line TL. Each relaying means 33–35 has a communication device and is connected to a respective hall call button 45–47. With this connection, each relaying means 33–35 is capable of transmitting the hall call signal KEY generated at a respective hall call button 45–47 through the communication device to the corresponding car controller 31, 32. Each relaying means 33–35 is also capable of outputting signals D0–D8 representative of running information as well as selection signals CLK1 CLK2 for selecting a respective indicator in response to a current position signal, a traveling direction signal, and a selection signal selecting one of the plurality of only communication-purpose repeaters transmitted through the commonly shared communication line from the corresponding car controller. The information indicating apparatus further includes: a plurality of car position indicators 36–41 arranged on each of the floor landing by the same number with the elevator cars and connected to the signal relaying means so as to receive the current position signal of the respective elevator car and the selection signal from the signal relaying means and to thereafter indicate the received current position signal; a plurality of car traveling direction indicators 42–44 each arranged on each of the floor landing commonly for two elevator cars and connected to the respective signal relaying means, and receiving therefrom the signal representative of current car traveling direction so as to indicate the information signal representative of current car traveling direction; and a plurality of signal lines for connecting the plurality of hall call buttons, the plurality of car traveling direction indicators, and the plurality of car position indicators to the plurality of signal relaying means.

As, herein, the plurality of signal relaying means 33–35 are capable of decoding so as to thereafter output car information signals D0–D7, D8 and selection signals CLK1 CLK2 after when the current position information data and the car traveling direction information data are received through the separate lines from the main communication line, the car position indicators 36–38 for indicating the current position of the first elevator car are activated upon the receipt of the decoded data D0–D7 as well as a clock signal CLK1 transmitted from one of the signal relaying means 33–35 whilst the car position indicators 39–41 for indicating the current position of the second elevator car are activated upon the receipt of the decoded data D0–D7 as well as a clock signal CLK2 transmitted from one of the signal relaying means 33–35.

Figure 5:
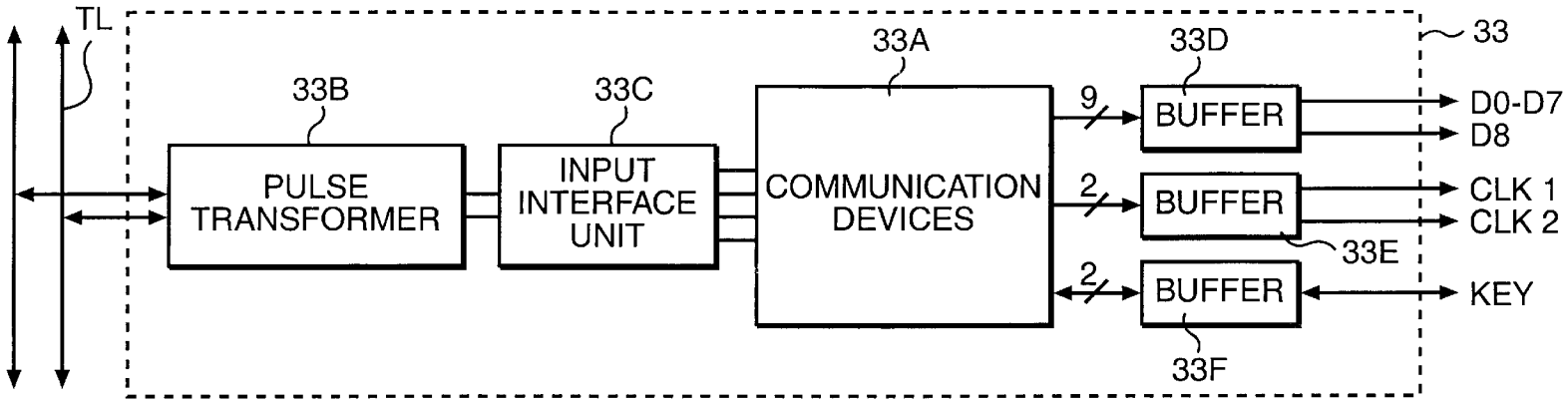
FIG. 5 is a detailed block diagram showing construction of a signal relaying means shown in FIG. 4.

FIG. 5 is a block diagram showing construction of a signal relaying means shown in FIG. 4. The signal relaying means 33 at the top terminal floor landing is represented in the FIG. 5. The signal relaying means 33 includes a pulse transformer 33B, an I/O interface unit 33C, a dual direction communication device 33A, and three buffers 33D, 33E and 33F.

The pulse transformer 33B receives through the communication line TL the car position data and the up/down direction data in a bipolar coded type format, then amplifies the data received from through the communication line TL to a predetermined level, and/or makes amplitudes of the hall call signal generated at the hall call board be smaller. The I/O interface unit 33C receives the messages from the pulse transformer 33B, and then converts the bipolar coded message to the binary coded message or vice versa. The communication device 33A is two-way operable. Therefore, in one hand, the dual direction communication device 33A receives the binary coded message from the I/O interface unit 33C, processes/outputs data D0–D7 and D8 ,and clock signals CLK1, CLK2. On the other hand, the dual direction communication device 33A receives the hall call request messages KEY from the hall call board, converts the messages into binary coded messages, and then transmits the same message to the I/O interface unit 33C. A plurality of buffers 33D~33F temporarily store the data D0–D7 and D8, clock signals CLK1, CLK2, and the hall call request data KEY respectively.

Figure 6:
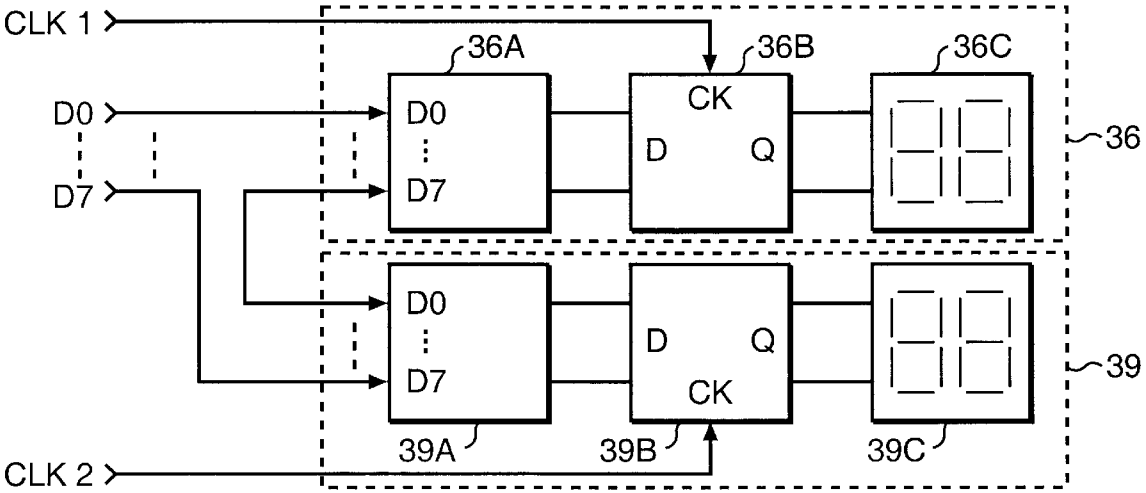
FIG. 6 is a block diagram showing construction of a car position indicator shown in FIG. 4.

FIG. 6 is a block diagram showing construction of a car position indicator shown in FIG. 4. The car position indicator 36, 39 in FIG. 6 is the one installed at the top terminal floor landing. The car position indicator 36, 39 respectively includes a decoder 36A, 39A, a flip-flop 36B, 39B, and a digital display matrix 36C, 39C. The decoder 36A, 39A receives the data D0–D7 supplied from the signal relaying means, decodes the data such that the format of the data can be inputted to the digital display matrix 36C, 39C. The flip-flop 36B, 39B accomplishes the normal flip flop function by controlling the time of generating output data Q with the clock signals CLK1, CLK2 supplied from the only communication-purpose repeater. The digital display matrix 36C, 39C receives the data from the flip-flop 36B, 39B , and display the current car position of assigned elevator car.

Figure 7:
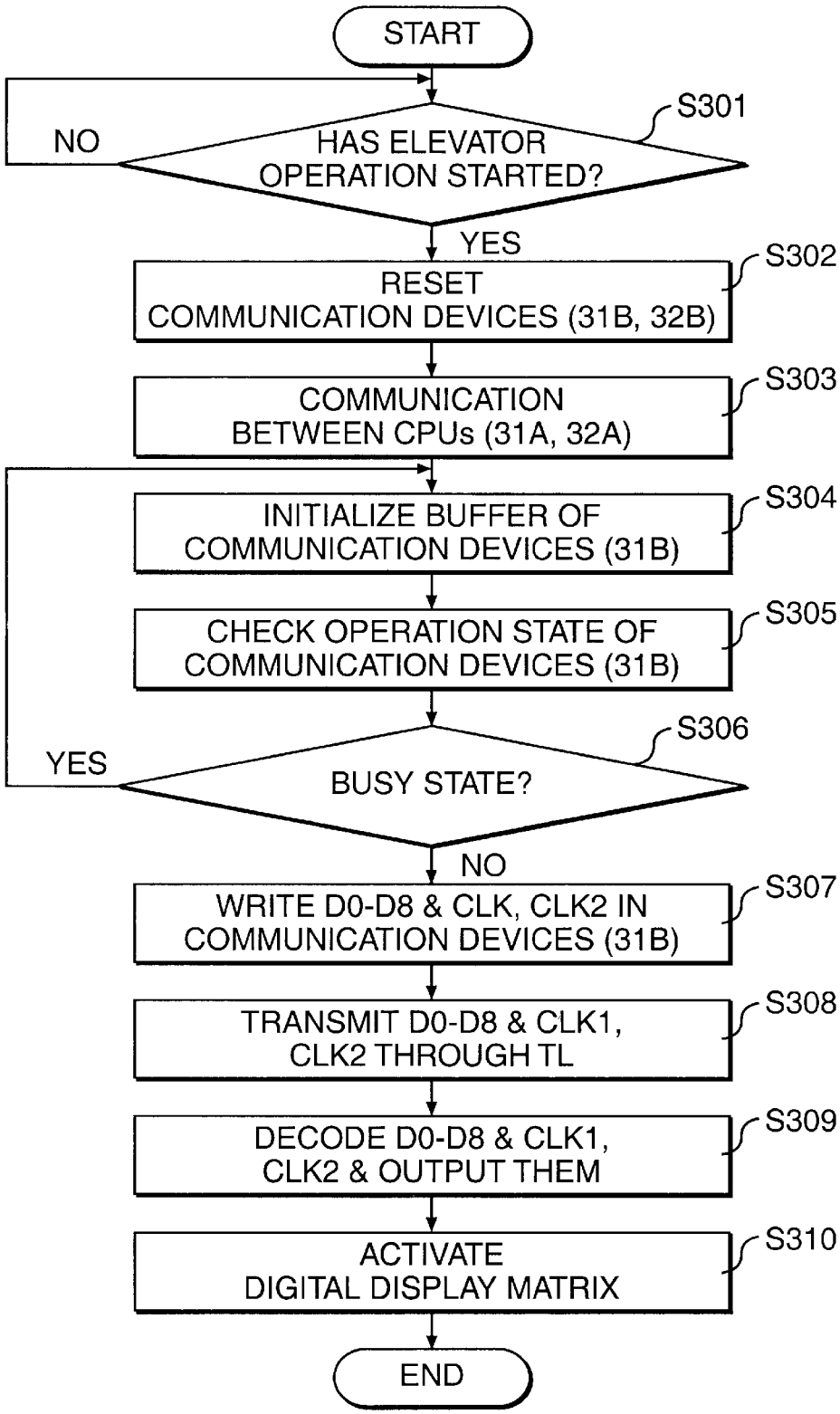
FIG. 7 is a flow diagram showing the principal operating steps of the apparatus shown in FIG. 4.

FIG. 7 is a flow diagram showing the principal operating steps of indicating car position and traveling direction of the elevator car using the system shown in FIG. 4. Referring still to the FIG. 7, the car controller 31 controlling the first elevator car is a master car controller. However, the car controller 32 controlling the second elevator car of course, can be a master car controller if desired.

Referring further to FIG. 7, if the power is supplied to the system, the first and second elevator cars are thereafter activated S301. Then, the central processing unit 31A, 32A resets S302 communication devices 31B, 32B respectively. The communication between the central processing unit 31A and the central processing unit 32A takes place during transmitting/receiving S303 where the inter-elevator messages are exchanged to/from each other to assign the appropriate elevator car responding to the hall call request message such that the efficiency of the whole elevator system is increased. Almost at the same time, the S304 is executed, in which the central processing unit 31A, 32A sets transmitting buffer disposed at the dual direction communication devices 31B, 32B with the initial values, checks S305 the operation status of the communication devices 31B, 32B, and then determines S306 which one 31B, 32B of operation status is 'not busy' until it finds one. After the central processing unit 31A, 32A finds the respective communication device of which the transmission buffer is idle, the central processing unit 31A, 32A outputs S307 the car position data D0–D8 and the car position indicator selection signals CLK1, CLK2, which may select one of the car position indicators 33~35, and then controls S308 the dual direction communication device 31B, 32B to transmit the car position data D0–D8 and one of the respective car position indicator selection signal CLK1, CLK2 to the respective signal relaying means 33~35 through the communication line TL. And then, the S309 is executed, in which the signal relaying means 33~35 receives the data and clock signals through the communication line TL, processes the incoming input signals, and then transmits the processed signals to the respective car position indicator 36~41. The car position indicator 36~41 decodes the incoming data to activate the digital display matrix. The digital display matrix disposed in the car position indicator displays S310 the arbitrary number representative of the presently positioned floor of the assigned elevator car so that the passengers waiting for the elevator car can be informed about what goes on, just after they press the hall call button disposed in the hall call boards 42~44. The car position information indicating operation is herein described under the condition that car controller 31 for the first elevator car acts as a master controller, but the car controller 32 for the second elevator car can also be a master controller if desired.

Figure 1:
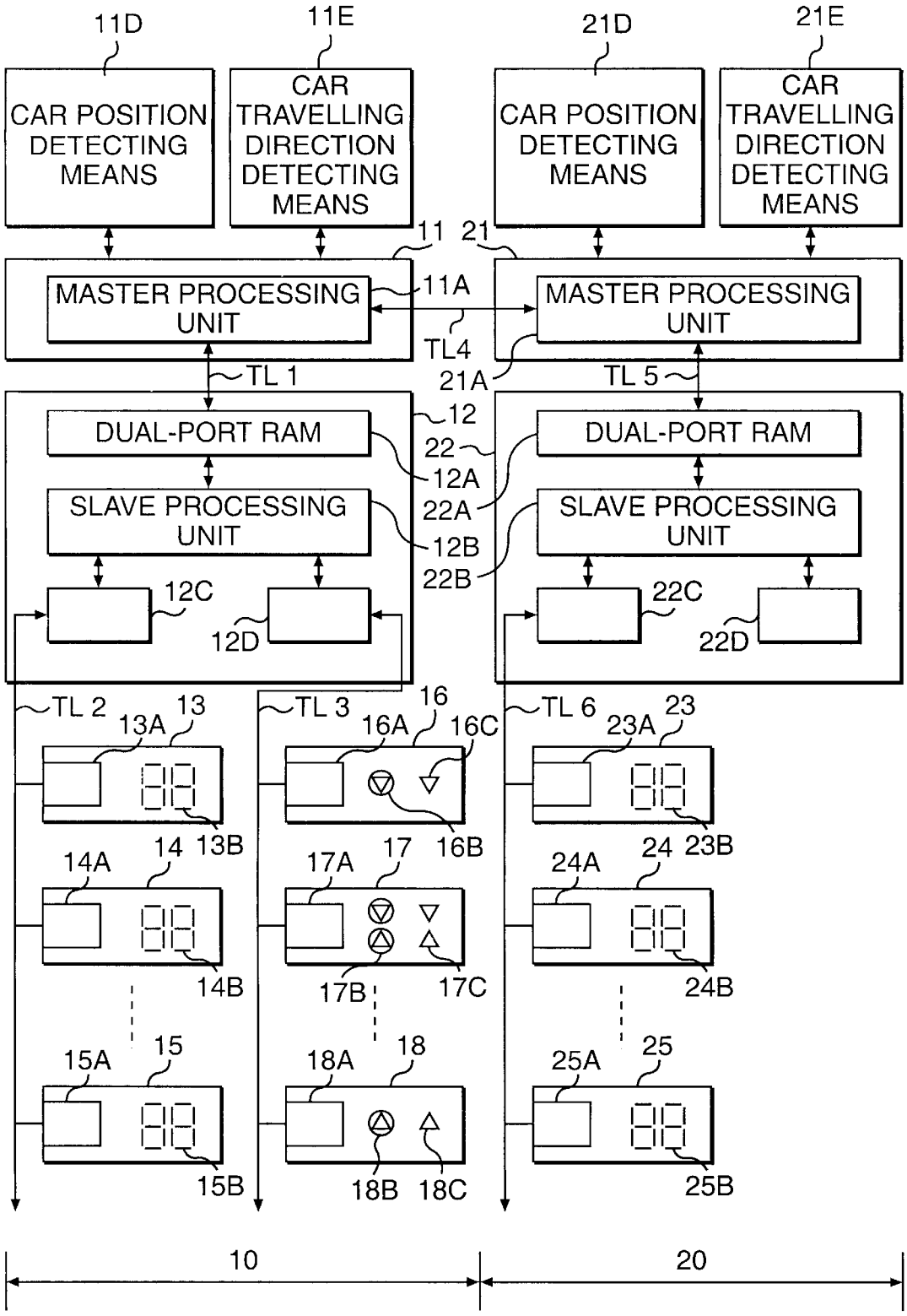
FIG. 1 PRIOR ART
FIG. 1 is a schematic diagram of car position information indicating apparatus of the prior art for two-elevator group in which two elevator cars are running in parallel
Figure 2:
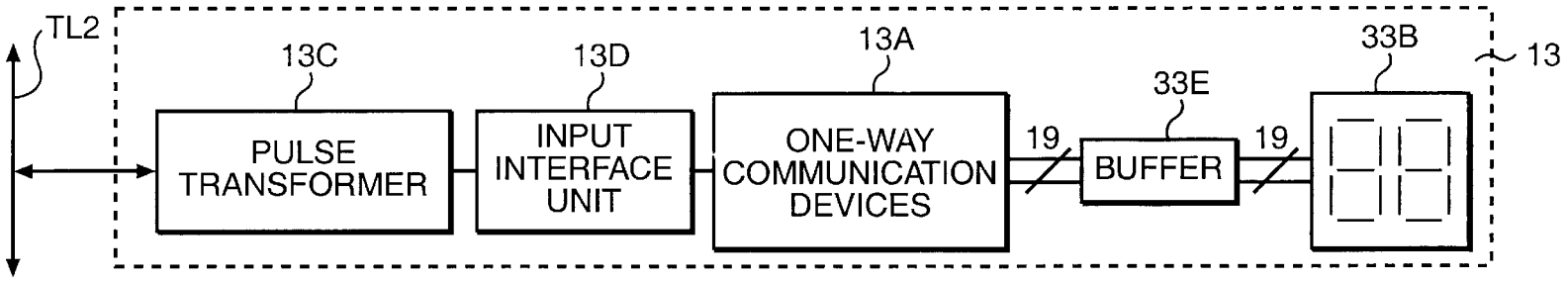
FIG. 2 PRIOR ART
FIG. 2 is a block diagram showing construction of a car position indicator shown in FIG. 1.
Figure 8A:
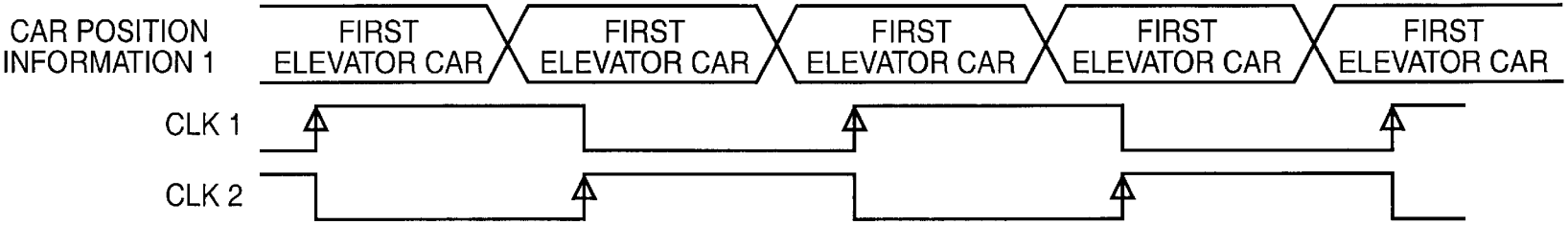
FIGS. 8*a* and 8*b* illustrate waveforms of clock pulse data and car position data generated at the car controller shown in FIG. 4, when a single elevator car is operating and when two elevator cars are operating respectively.
Figure 8B:
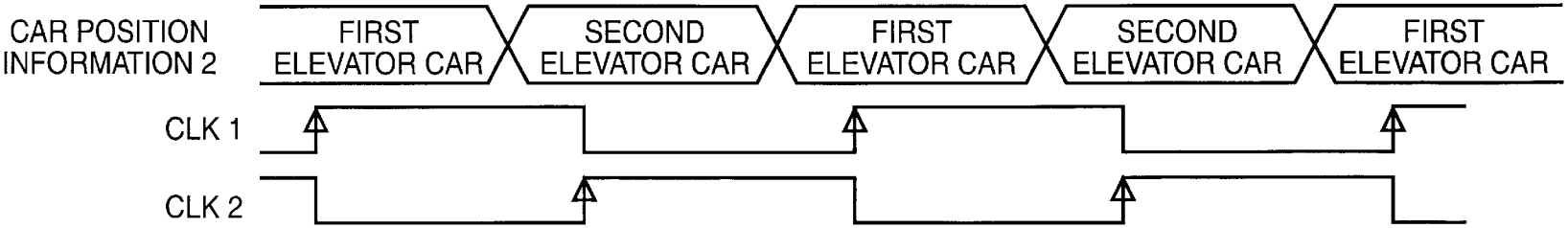
Figure 3:
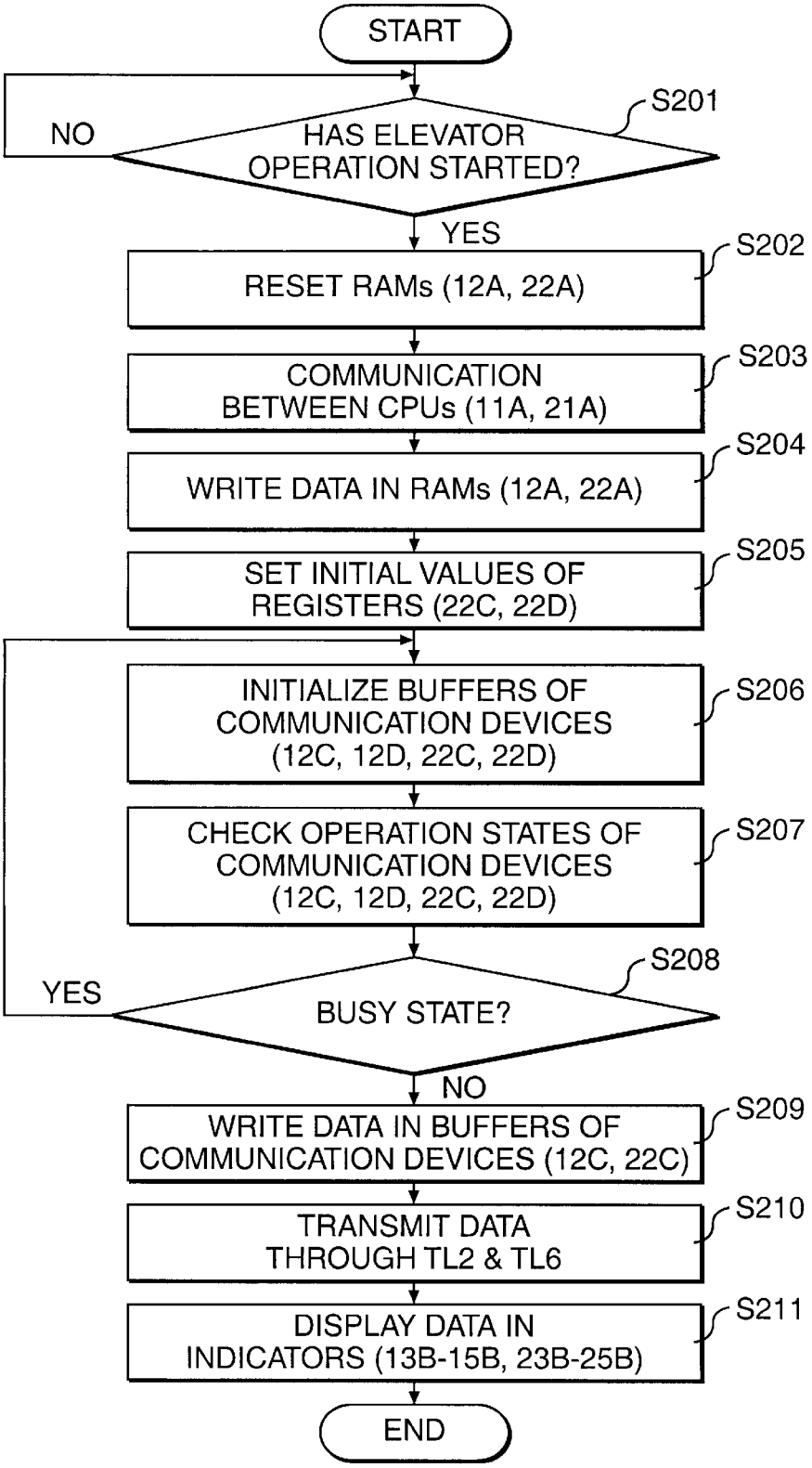
FIG. 3 PRIOR ART
FIG. 3 is a flow diagram showing the principal operating steps of the apparatus shown in FIG. 1.

FIGS. 8*a* and 8*b* are timing diagrams showing the relationship between the clock pulse signals CLK1, CLK2, and the enable/disable status waveform(s) of the signal relaying means which are generated at the car controller shown in FIG. 4, respectively when a single elevator car is operating, and when two elevator cars are running in parallel. Referring further to FIG. 8*a*, the central processing unit 31A disposed in the car controller 31 transmits a 12 bit long data which is made up with an 8 bit position data D0–D7, a 2 bit up/down traveling direction data D8(Δ,▽), and a 2 bit indicator selection data, to the respective signal relaying means 33~35. As can be seen in the FIG. 8*a*, the data representative of the car position, the up/down direction, and the selection is valid at the rising edge of a clock signal CLK1 in the apparatus where the single elevator car is running.

Furthermore, it can also be seen in the FIG. 8*b* that in the case the first elevator car and the second elevator car are running in parallel, the car related hall indicating data such as the car position data, the up/down direction data, and the indicator selection data for the cars are transmitted with the two clock signals CLK1, CLK2 at the same time, and herein those data for the first elevator car is valid at the rising edge of a clock signal CLK1, those data for the second elevator car is valid at the rising edge of a clock signal CLK2 in the same way.

Further, it can be understood that the car information data for the second elevator car is the same as the data for the first elevator car in the format, and the data (hall indication information 2) combining information data for both the first elevator car and the second elevator car are simultaneously transmitted with two clock signals CLK1, CLK2 in the case where the first elevator car and the second elevator car are running in parallel. Heretoforce, the information data for the first elevator car becomes valid at the rising edge of the clock signal CLK1, whilst the information data for the second elevator car becomes valid at the rising edge of the clock signal CLK2.

The operation of such a hall indication system will be described in more detail with the reference of the FIGS. 4 to 8.

The car controllers 31, 32 transmit the car position indicating data such as the car position data, the up/down traveling direction data, and the indicator selection data through the communication line TL to the respective signal relaying means 33~35.

The signal relaying means 33~35 accordingly receive the car position indicating data from the car controller 31, 32 respectively. The signal relaying means 33~35 accordingly transmits the respective signal thereby turning the respective up/down direction lamp 42–44 on, decodes the incoming car position indicating signals, and outputs the data D0~D8 representative of the car position number and the clock signals CLK1, CLK2 as indicator selection signals.

The data D0~D7 and clock signals CLK1, CLK2 generated at the only communication-purpose repeaters 33~35 are transmitted to the car position indicators 36~38 for the first elevator car as well as to the car position indicators 39~41 for the second elevator car at the same time, and the respective car position indicators 36~41 decode the incoming data to actuate the digital display matrix and the digital display matrix accordingly illuminates the arbitrary number representative of the car position.

Referring to the FIG. 6, the operation of the car position indicator 36 for the first elevator car and the car position indicator 39 for the second elevator car will be described in more detail. They are located on the top terminal floor landing. The car position data D0~D7 is firstly inputted to the decoder 36A, 39A which is realized as a programmable logic device (Hereinafter, referred as a PLD) in the embodiment of the invention. The PLD decodes incoming data to actuate the digital display matrix and transmits the decoded data to the input port D of the flip-flop 36B, 39B. The flip flop does not send the incoming signal to the output port Q unless the clock signal CLK1, CLK2 is received at the CK port. Therefore, even though the data D0~D7 is transmitted to the car position indicator 36 for the first elevator car as well as to the car position indicator 39 for the second elevator car at the same time, only one of the car position indicator whose flip flop received the clock signal CLK1, CLK2 is therefore capable of displaying the arbitrary number representative of the car position.

Each car position indicator 36~38 receives the data D0~D7 and the clock signal CLK 1 and each car position indicator 39~41 receives the data D0~D7 and the clock signal CLK2. Therefore, the system is capable of simultaneously activating one of the respective car position indicators 36~38 for the first elevator car as well as one of the respective car position indicators 39~41 for the second elevator car.

Referring now to FIG. 7, the operation of the digital display matrix will be described as follows.

The determination whether or not the elevator system is activated is made S301. If it is determined that the system is activated S301, each of the CPU 31A, 32A disposed in the car controller 31,32 respectively resets S302 each dual direction communication device 31B, 32B and simultaneously makes S303 determination whether or not the assigned elevator car of which the car position data is displayed is the first elevator car or the second elevator car.

The CPU 31A sets S304 the transmission buffer 31B of the dual direction communication device 31B with the initial values, and reads S305 the operation status at every predetermined time interval. After execution of the step of S305, the CPU 31A determines S306 whether or not the operation status of the transmission buffer is busy. If it is determined that the operation status indicates not busy at the step of S306, the CPU 31A records S307 the data D0~D7, the up/down direction data, the hall lantern activation data at the transmission buffer and transmits S308 the data D0~D7 retrieved from the buffer and the clock signals CLK1, CLK2 through the communication line TL to the respective signal relaying means 33~35. If it is determined that the operation status of the transmission buffer is busy at the step of S306, it returns to the step of S304. After the execution of the step of S308, the only communication-purpose repeater receives the data D0~D7, the up/down direction data, the car indicator selection data and the clock signal CLK1, CLK2 and transmits them to the respective car position indicator as well as the respective hall call board. The respective hall call board and the car position indicator accordingly display S310 the respective data upon the receipt of the respective data.

According to the present invention described above, the running information of the plurality of elevator cars are accomplished by signal relaying means that do not include a CPU to support the indication related system to perform its function with the use of the serial communication line and other data lines in response to the output signals of the car controllers. A plurality of RAMs and ROMs required by CPUs normally used in the floor controller boards becomes unnecessary which substantially reduces the cost of the system greatly while also reducing the system volume.

What is claimed is:

1. An elevator control system comprising:

a plurality of elevator cars, each elevator car having a position detector, a traveling direction detector;

a car information indicating apparatus including, a plurality of hall call buttons, each hall call button generating a hall call signal upon activation;

a plurality of car controllers, each car controller including a central processing unit and a dual direction communication device for outputting elevator car position information signals, elevator car direction traveling signals, and hall call signals;

a communication line operatively linking the plurality of car controllers, whereby transmitting and receiving coded messages can be executed serially;

a plurality of signal relaying devices being operatively linked together by said communication line, each signal relaying device being capable of transmitting and receiving the coded messages to and from the plurality of car controllers via said communication line, each signal relaying device decoding the coded messages, each signal relaying device being capable of generating clock signals and receiving request messages from a respective hall call button, said plurality of signal relaying devices operatively linked in parallel substantially reducing hardware associated with each respective hall call button;

a plurality of car position indicators, each car position indicator operatively linked to a respective signal relaying device to receive decoded messages relating to elevator car position information; and a plurality of car traveling direction indicators, each car traveling direction indicator operatively linked to a respective signal relaying device to receive decoded messages relating to elevator car directional information.

2. The elevator control system of claim 1, wherein each dual direction communication device of each car controller encodes said coded messages, said coded messages relating to car position information, each dual direction communication device outputting hall call signals received from respective signal relaying devices to a respective central processing unit of a car controller.

3. The elevator control system of claim 1, wherein each car position indicator further includes, a decoder for receiving and decoding coded messages from a respective signal relaying device;

a flip-flop operatively linked to the decoder for outputting decoded messages in response to clock signals generated from a respective signal relaying device; and a digital display matrix for displaying a position of a respective elevator in accordance decoded messages outputted from a respective flip-flop.

4. The elevator control system of claim 1, wherein said coded messages are binary coded messages.

5. The elevator control system of claim 3, wherein said decoder for receiving and decoding coded messages is a programmable logic device.

* * * * *